US007278548B2

(12) United States Patent
Rieck et al.

(10) Patent No.: US 7,278,548 B2
(45) Date of Patent: Oct. 9, 2007

(54) CLOSURE LID WITH A DUAL PANEL AND THE PRODUCTION THEREOF

(75) Inventors: Hajo Rieck, Grafschaft (DE); Lutz Strube, Koenigslutter (DE); Dieter Heinecke, Wendeburg (DE)

(73) Assignee: Ball Packaging Europe GmbH, Ratingen (DE)

( * ) Notice: Subject to any disclaimer, the term of this patent is extended or adjusted under 35 U.S.C. 154(b) by 286 days.

(21) Appl. No.: 10/468,913

(22) PCT Filed: Mar. 1, 2001

(86) PCT No.: PCT/DE01/00775

§ 371 (c)(1),
(2), (4) Date: Dec. 1, 2003

(87) PCT Pub. No.: WO02/070358

PCT Pub. Date: Sep. 12, 2002

(65) Prior Publication Data

US 2004/0129703 A1 Jul. 8, 2004

(51) Int. Cl.
*B65D 1/36* (2006.01)

(52) U.S. Cl. ..... 220/521; 220/522; 220/256.1

(58) Field of Classification Search ..... 220/521, 220/522, 257.1, 257.2, 256.1
See application file for complete search history.

(56) References Cited

U.S. PATENT DOCUMENTS 2,120,403 A * 6/1938 Godfrey ..... 40/307
2,804,201 A * 8/1957 Chappell ..... 206/232
3,067,867 A * 12/1962 Bonham et al. ..... 206/223
3,262,602 A * 7/1966 McConnell et al. ..... 220/785

(Continued)

FOREIGN PATENT DOCUMENTS

EP 773891 B1 12/1999

(Continued)

OTHER PUBLICATIONS

Betsy McKay, "Pepsi to Lift Price of Soda Concentrate, Following Coca-Cola's Strategic Shift," Wall Street Journal.

(Continued)

*Primary Examiner*—Anthony D. Stashick
*Assistant Examiner*—Harry A Grosso
(74) *Attorney, Agent, or Firm*—Hunton & Williams

(57) ABSTRACT

The invention pertains to a cover for a beverage can body (3) with an inner and an outer cover panel (30, 10) that are spaced apart from one another ($h_{20}$) in the axial direction (100) such that an intermediate space (20) is formed which is able to accommodate an object (44, 45) that is invisible from the outside—from a viewing direction toward the outer cover panel (10). The inner cover panel (30) is connected to a mounting edge (36) via a curved section (30*r*) that forms a peripheral groove (2*a*) around the cover panel in order to realize the attachment to the beverage can body. The outer cover panel (10) is clamped relative to the inner cover panel (30) with an essentially radial force component ($f_{11}$) such that a clamping point (11, 31) is formed in order to fix its axial distance ($h_{20}$) relative to the inner cover panel (40).

18 Claims, 6 Drawing Sheets

U.S. PATENT DOCUMENTS

| | | | | |
|---|---|---|---|---|
| 4,087,018 | A * | 5/1978 | Tebbutt | 220/257.2 |
| 4,090,636 | A * | 5/1978 | Norton | 220/789 |
| 5,507,406 | A * | 4/1996 | Urciuoli et al. | 220/269 |
| 5,582,317 | A * | 12/1996 | Wermund | 220/789 |
| 5,996,833 | A * | 12/1999 | Lencioni et al. | 220/257.2 |
| 6,152,318 | A * | 11/2000 | Walker | 220/379 |
| 6,296,137 | B1 * | 10/2001 | Bj.o slashed.rnsen | 220/257.2 |

FOREIGN PATENT DOCUMENTS

| | | | |
|---|---|---|---|
| WO | WO96 04181 | A | 2/1996 |
| WO | WO97 19001 | A | 5/1997 |

OTHER PUBLICATIONS

"Coke Plans 'Discover Can' Promotion, Plus: Food Company Tie-ins and Contour Glass Giveaway," Beverage Digest, vol. 35, No. 11, Bedford Hills, NY (Nov. 19, 1999).

* cited by examiner 54
50
53
52
52a
10
1
56
11
37
38
54
53
50
1
52
30
2
100
3

$h_{65} \pm dh$

CLOSURE LID WITH A DUAL PANEL AND THE PRODUCTION THEREOF

The invention pertains to a cover for a can. Said cover comprises two cover panels that are spaced apart from one another in the axial direction such that an intermediate space (also refer to as a cavity) is formed which is able to accommodate a physical object, e.g., a prize, an award or a toy, that is invisible from the outside when the cover is intact.

BACKGROUND ART

A cover with a such a cavity and two cover panels that are spaced apart from one another is described in EP 773 891 B1 (Schmalbach-Lubeca), in particular in FIGS. 2, 3 and 4 as well as in column 2, paragraphs 9 and 10. This cover can be opened by removing the upper cover part or the upper cover panel such that the cavity with the price situated therein is exposed. In order to connect the two cover panels, it is absolutely imperative to utilize a food-compatible adhesive that is defined in such a way that it allows the separation of the upper cover panel from the lower cover panel; see column 3, first paragraph. When the upper cover part is removed, a residual amount of the adhesive remains on the adhesive connection.

SUMMARY OF INVENTION

The invention is based on the objective of eliminating recyclings, adhesive residues or other auxiliary means that influence the respective surfaces and of proposing a cover construction that makes it possible to separate one cover panel from another cover panel in order to expose the cavity, namely without the utilization of such adhesives. In other words, the invention aims to realize an adhesive—free arrangement of the cover which simultaneously fulfills the requirement that the user is unable to externally distinguish two different beverage cans from one another, namely a beverage can that contains two cover panels and a beverage can that contains only one cover panel. This means that the respective outer cover panels, i.e., the upper (outer) cover panel of the two cover panels and the only cover panel of a beverage can cover or beverage can that is not provided with a cavity, essentially need to be arranged at the same height in order to achieve the same optical effect.

The invention utilizes a connecting technique that fixes the outer cover panel relative to the inner cover panel by means of a frictional connection. The (elastic or radial) force component acts upon a clamping point and ensures that the two cover panels are securely positioned relative to one another. The clamping point may lie radially outside the cover panel, preferably in a cover wall that extends from the peripheral groove (frequently also referred to as a core groove) to the mounting edge (frequently realized in the form of a folded edge). At the clamping point, an edge that protrudes radially outward non-positively engages on a seat, wherein a force component that is essentially directed radially ensures a solid connection of the outer cover panel (that serves as the visible or axially upper cover panel). The frictional connection requires no additional adhesive substance.

The frictional connection is adjusted in such a way that it suffices for fixing the two cover panels relative to one another, wherein the frictional connection can be separated when the can is opened by means of an outer cover panel.

When pulling or exerting a lever force on a handle part on the outer cover panel, a tensile force component ensures that the outer cover panel is separated from the clamping point. In this case, the cover panel is realized in the same fashion as the tear-open region of a conventional beverage can cover in the region of its handle strap (the handle part). When a beverage can is opened, the tear-open region is superficially cracked in order to alleviate the pressure, wherein the opening element is downwardly supported on the physical object inserted into the cavity in order to simplify the removal of the outer cover panel due to the separation of the press fit at the clamping point.

It is preferred that the radial force of an apron on the outer panel essentially acts radially outward such that a section of the cover which lies radially outward and extends axially at a certain incline serves as the clamping or supporting point. It would also be conceivable to utilize a force that acts radially inward, wherein the supporting point would have to be correspondingly shifted in this case.

The force component is achieved by means of an elastic deformation of an apron section on the edge of the panel, wherein a slight curvature of the larger outer cover panel boosts this force and promotes the generation thereof.

Due to the outwardly curved outer cover panel, a casual observer has the perception that the internal pressure of a closed can containing a carbonated beverage is very high. Although the inwardly directed surface of the outer cover panel is not subjected to such a pressure due to the arrangement of two cover panels that are axially spaced apart from one another, a casual observer has the perception that the outer cover panel is subjected to such a pressure. The gas pressure is absorbed by the inner cover panel that, however, is invisible when the outer cover panel is in the mounted position. Once mounted, only the outwardly curved outer cover panel is visible.

The outwardly directed curvature is realized by means of a deformation before the mounting of the outer cover panel. If beverage cans that are closed with a double panel cover should be indistinguishable from beverage cans with only one panel, the axial height of the outer cover panel essentially corresponds to that of the single cover panel on a normal beverage can.

In order to reinforce the clamping point, a narrow peripheral strip is provided which forms part of the inwardly directed outer cover wall that extends in the axial direction at a certain incline.

The strip is limited by an upper and a lower shoulder, wherein said strip diverges from the inclined orientation of the aforementioned cover wall and can essentially be considered to be extending axially. If an essentially axial orientation is chosen, the strip may be slightly inclined in a conical fashion in order to improve the press fit. In this case, the angle of inclination lies between 0° and 6°, preferably between 2° and 3°, wherein it would, if so required, also be conceivable to realize negative angles.

The outer wall on the cover extends from the folded edge into the peripheral groove radially outside the lower cover panel, wherein the peripheral strip is provided approximately at the height of the inner cover panel that may either extend in essentially the horizontal direction or be slightly curved analogous to the outer cover panel.

If the inner cover panel also contains an opening system with a handle strap the support effect for exerting the tensile force upon the opening system of the outer cover panel can already be achieved with small physical objects in the closed or concealed cavity.

The axial height of the narrow strip, on which the clamping point is formed, amounts to a multiple of the sheet thickness of the end section of the apron region or of the sheet thickness of the outer cover panel.

In a cover according to the invention which is provided with two panels, two axially and radially offset grooves are produced. The material at the bottom of the lower groove is realized continuously. The material at the bottom of the upper groove that is offset axially upward and radially outward is divided, wherein said division is realized at the clamping point. The inner curved section may be slightly offset relative to the upper step in the edge region of the narrow peripheral strip because this is barely visible from the outside if the groove has a corresponding depth. This offset could, if at all, only be detected with a pointed tool, i.e., a double panel can and a conventional single panel can are indistinguishable.

When the double panel cover is closed, one of the two grooves is invisible from the outside. Both grooves are oriented in the same direction, namely toward the interior of the beverage can body when the body is closed.

The invention also proposes tools and a method for positioning the outer cover panel and for producing the corresponding press fit.

For this purpose, a tool is utilized which engages on the outer cover panel from the top and comprises a peripheral joining rib that engages on the apron geometry on the outer edge of the cover panel, but is spaced apart from the inclined wall between the press fit and the mounting edge in the radially outward direction.

In most instances, this shape can be achieved with an outer surface on the joining rib which extends obliquely referred to the axis and is inclined radially outward. This surface ends in such a way that the press fit on the outer side is, if at all, only insignificantly contacted during the engagement of the joining rib in order to realize the insertion of the clamping edge of the apron by means of an axially downward directed force on the press fit with the front geometry of the joining rib. The angle of inclination of the outer surface lies below 30°, preferably between 5° and 15°.

The front geometry of the axially oriented joining rib is designed for realizing a large pressing surface on the lower region of the apron. This is achieved if the curvature of the inwardly directed surface of the joining rib largely adjoins the curved region of the apron and extends relatively far in the direction of the free apron edge. A change in the surface incline is realized in front of the free edge. In other words, a bend or at least a bend-like transition into a second radially outward directed surface is produced. It would be possible to reduce the width between the peripheral bend and the curved, inwardly directed section on the lower end of the joining rib. However, this would reduce the surface area and increase the surface pressure exerted upon the lower end of the apron to be pressed in.

Since the free edge moves radially outward during the insertion in order to generate the clamping force and since the joining rib should not contact the press fit with its outwardly directed surface, the dimension of the bend up to the free edge 11 is chosen such that the free edge has a smaller radial dimension than before in the clamped state.

The force with which the clamping edge engages on the clamping point (the seat) in the form of a radially outward directed terminal edge of the apron can be adjusted with another tool for realizing a radial widening before the insertion. For this purpose, the upper cover section is inserted into a support element with its cover panel, wherein said support element comprises an annular region, on which the edge region of the cover panel lies such that the upper end of the apron section remains free. An upper calibrating tool with a predetermined penetration depth engages on the inner surface of the apron geometry from the top and presses the apron outward such that it is deformed in a plastic fashion.

An adjusting element that may be assigned either to the calibrating tool part or the support part defines the penetration depth and consequently the radial plastic deformation of the apron before it is subsequently pressed into the press fit by the joining rib of the above-mentioned tool.

It goes without saying that an apron geometry that was radially deformed in a plastic fashion leads to a change in the radially acting, elastically exerted clamping force component. This means that it is possible to adjust the force with which the outer cover panel pops out or separates from the press fit when it is opened with the aid of the handle part.

An iterative method makes it possible to adjust a suitable clamping force for the subsequent plastic deformation if the adjusting part in the calibrating tool for the support element can be varied in small (discreetly graduated) increments. The thusly determined calibration achieved by predetermining the diameter of the free edge can be utilized on the upper panel and the apron of all other cover sections.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF PREFERRED EMBODIMENT

Embodiments of the invention are described in greater detail below, whenever it should be emphasized that the following description pertains to preferred embodiments of the invention.

Figure 1:
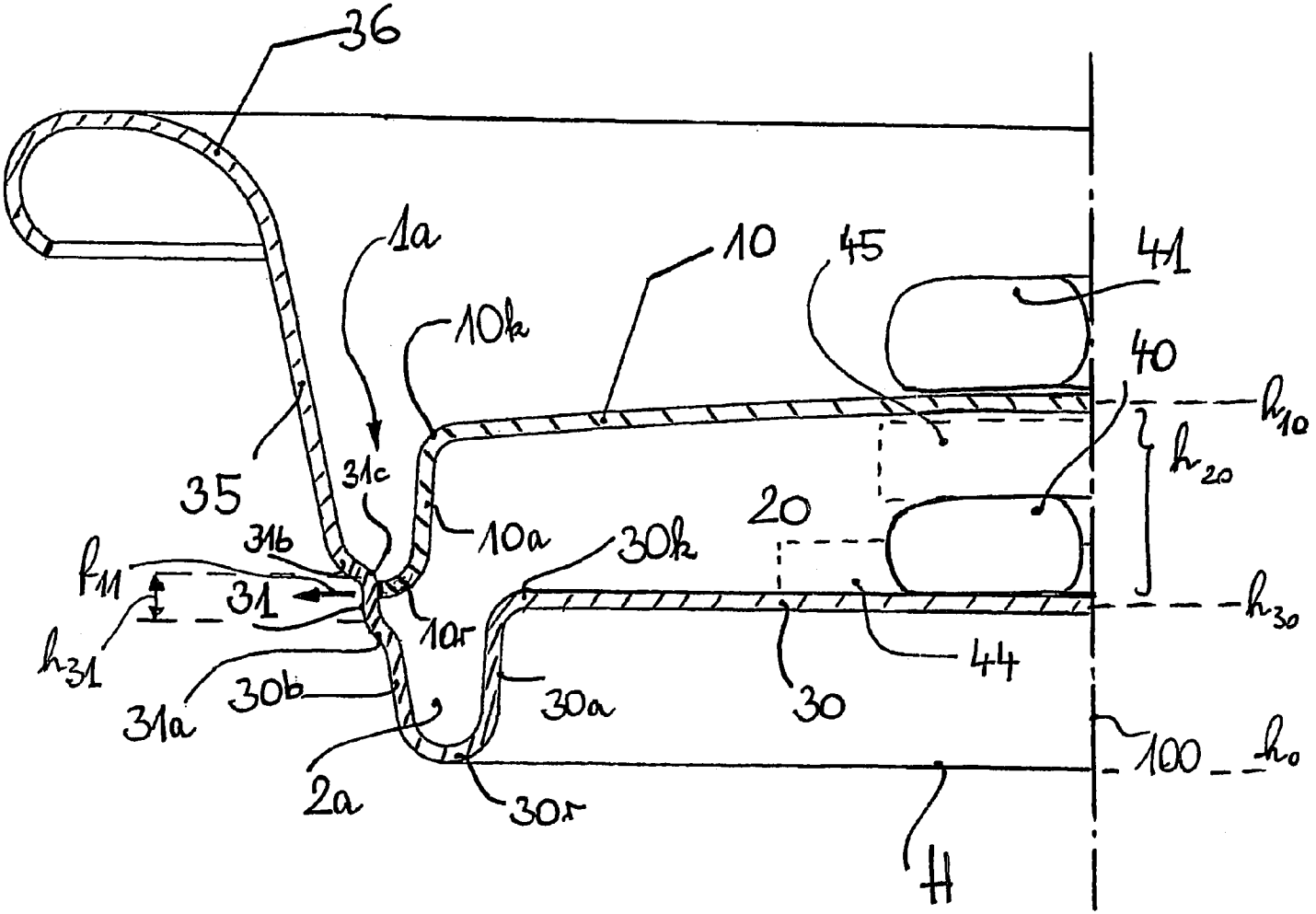
FIG. 1 shows a sectional representation of a sheet metal cover that comprises two cover panels 10, 30, wherein the portion of the cover situated to the right of the axis 100 is omitted and only the left portion is illustrated. Assuming that this axis forms a central axis, the right portion may be realized in the same fashion as the left portion with the exception of handle straps 40, 41 that are realized differently to the right of the central axis 100 (break-open tab instead of a ring handle).

The sectional representation according to FIG. 1 shows a central axis 100 of a beverage can cover that consists of sheet metal. This cover has an edge region 36 that is suitable for producing a folded seam connection with a (not-shown) can body flange. This loop-shaped edge region transforms into a peripheral groove consisting of two side walls 30*b* and 30*a* and a curved groove bottom 30*r* via an inclined wall section 35. The two wall sections 30*b*, 30*a* and the groove bottom 30*r* form a peripheral groove 2*a* that is placed around a cover panel 30 extending radially inward from the groove via a curvature 30*k*. A strap element 40 with a sectionally illustrated ring handle is provided in the central region of the cover, wherein said strap element may also extend up to the edge region if the cover has a smaller diameter. A conventional opening region consisting of notches for defining a break-open section and depressions around the strap element are also provided in this case, but not visible in the sectional representation shown. FIG. 1 of the initially cited publication shows one example.

Another wall section 31 is provided in the outer wall between the outer groove wall 30*b* and the wall section 35, wherein the additional wall section diverges from the continuously extending incline of the wall section 35 and is essentially oriented vertically via peripheral shoulder-like bends 31*b*, 31*c* and 31*a*. This wall section which is referred to as the strip 31 below is illustrated in the form of an enlarged detail in FIG. 2*a*, wherein its height in the straight region amounts to $h_{31}$.

A second outwardly curved cover panel 10 is arranged above the cover panel 30 that may also be slightly curved outward in contrast to the essentially plane embodiment shown. With respect to a closed can, in which the cover panel 10 is visible from the outside, this second cover panel is referred to as the outer cover panel below. This second cover panel also comprises an opening element with a handle strap and a ring handle 41 and the beginning of a peripheral groove that is formed by the transition of the cover panel 10 in the form of a curvature 10*k* realized similar to the curvature 30*a* and an inner groove wall 10*a*, as well as a curvature section 10*b* and a section of a radially aligned groove bottom 10*r*. These elements from the beginning of a second groove 1*a*, wherein the section of the groove bottom 10*r*, the ensuing curvature 10*b* and the inner wall 10*a* of the groove 1*a* are collectively referred to as a peripheral apron below. This apron begins in the curvature radius 10*k*.

The curvature of the outer panel 10 is realized before its installation under high pressure, for example a pressure of 6 bar (0.6 MPa), in order to indicate an internal pressure in the mounted state. However, the internal pressure does not act upon the underside of the outer panel because the internal pressure of a closed can (that is filled with a carbonated beverage) is absorbed by the inner cover panel.

The distance between the two cover panels in the center is identified by the reference symbol $h_{20}$, wherein the respective axial heights have absolute values that are identified by the reference symbols $h_{10}$ and $h_{30}$ for the outer cover panel 10 and the inner or lower cover panel 30. These absolute height values refer to the lowest point of the cover $h_0$, in this case the groove bottom 30*r* and the lowest plane H when observing the cover as such. Once a folded seam connection between the cover and the can is produced—as illustrated in FIG. 3—the lowest point is the ground contact ring of the can on the bottom of the beverage can which is curved in the shape of a dome.

In FIG. 1, a chamber 20 that is invisible from the outside lies between the two cover panels. It is possible to place a surprise object such as a disk-shaped price information 44 or another physical object 45 into the intermediate space 20 in the region of the inner handle strap. This object is invisible from the outside when it is situated in the chamber 20. The object is arranged in the hollow space between the two cover panels 10 and 30 which has the height $h_{20}$.

The mounting of the outer cover panel 10 above the inner cover panel 30 is realized with the aid of the apron 10*a*, 10*r* and the essentially axially aligned annular strip 31, namely in the form of a press fit on the outer cover wall. With respect to the incorporation of the upper cover panel 10 with the apron 10*a*, 10*b*, 10*r* into the press fit, we refer to FIGS. 2 and 2*a*. The outer radial dimension of the free edge 11 of the radial apron section 10*r* that represents a groove bottom section protrudes over a vertically extending annular surface V1 in the non-distressed state, namely by a differential dimension dr (for DELTA r or Δ r) referred to said surface and consequently also referred to the inwardly directed contact surface of the narrow annular strip with the height $h_{31}$. This narrow annular strip is composed of the sections 35, 31*b*, 31*c*, 31, 31*a* and 30*b* over the total length of the outer wall up to the groove bottom 30*r*.

Figure 3:
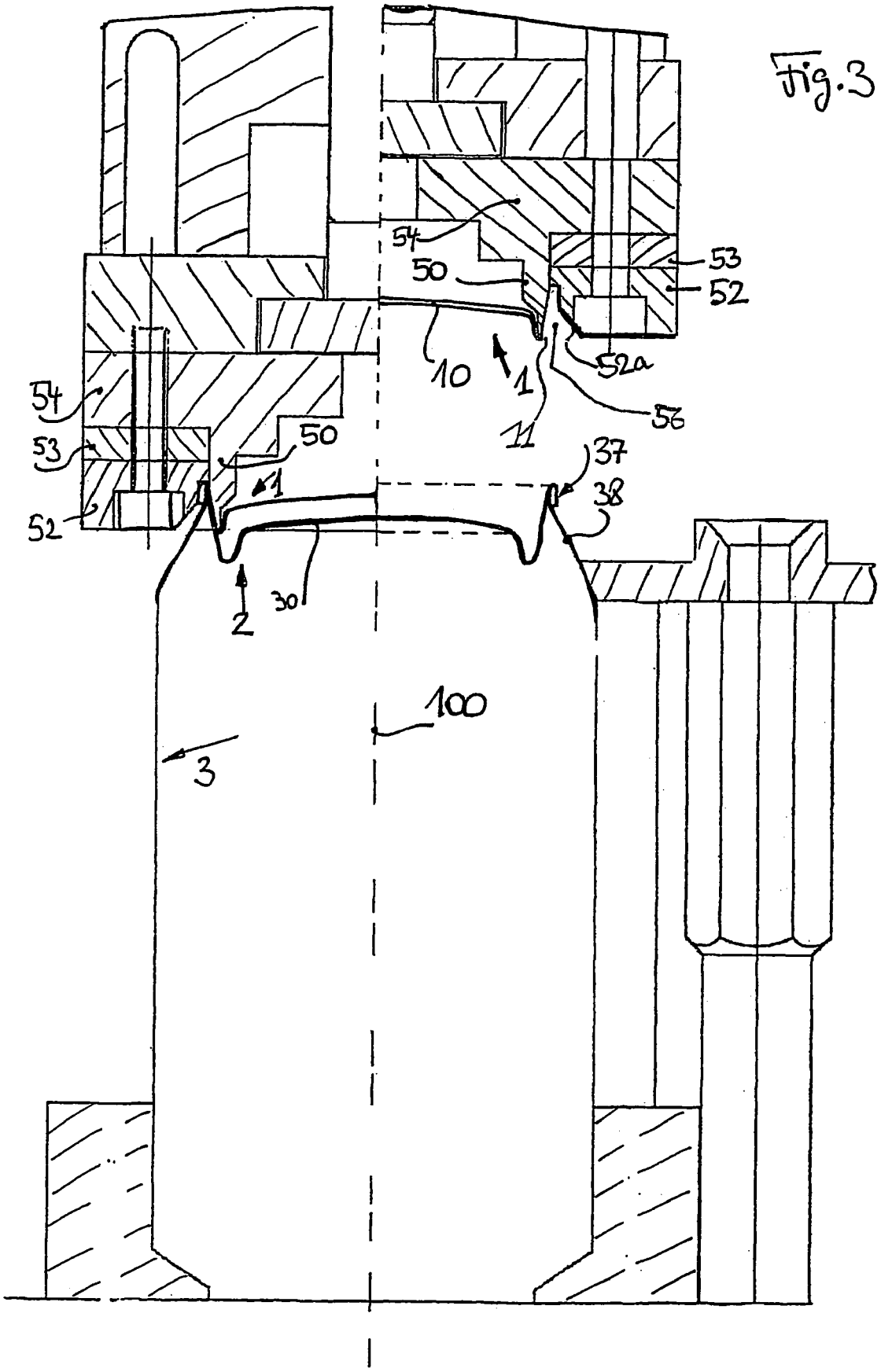
FIG. 3 shows a beverage can 3, into which a cover with two "panels" is inserted and connected by means of a folded seam, wherein the lower cover 2 and the upper cover panel 10 or cover section 1 are illustrated in the left half of the figure, in which the press fit was already produced due to the engagement with the lowered upper tool. The right half of the figure shows the upper cover panel 10 in the non-inserted state, in which the tool that produces the press fit when lowered as explained above with reference to FIGS. 2*a* and 2 is still in the raised position.
Figure 4:
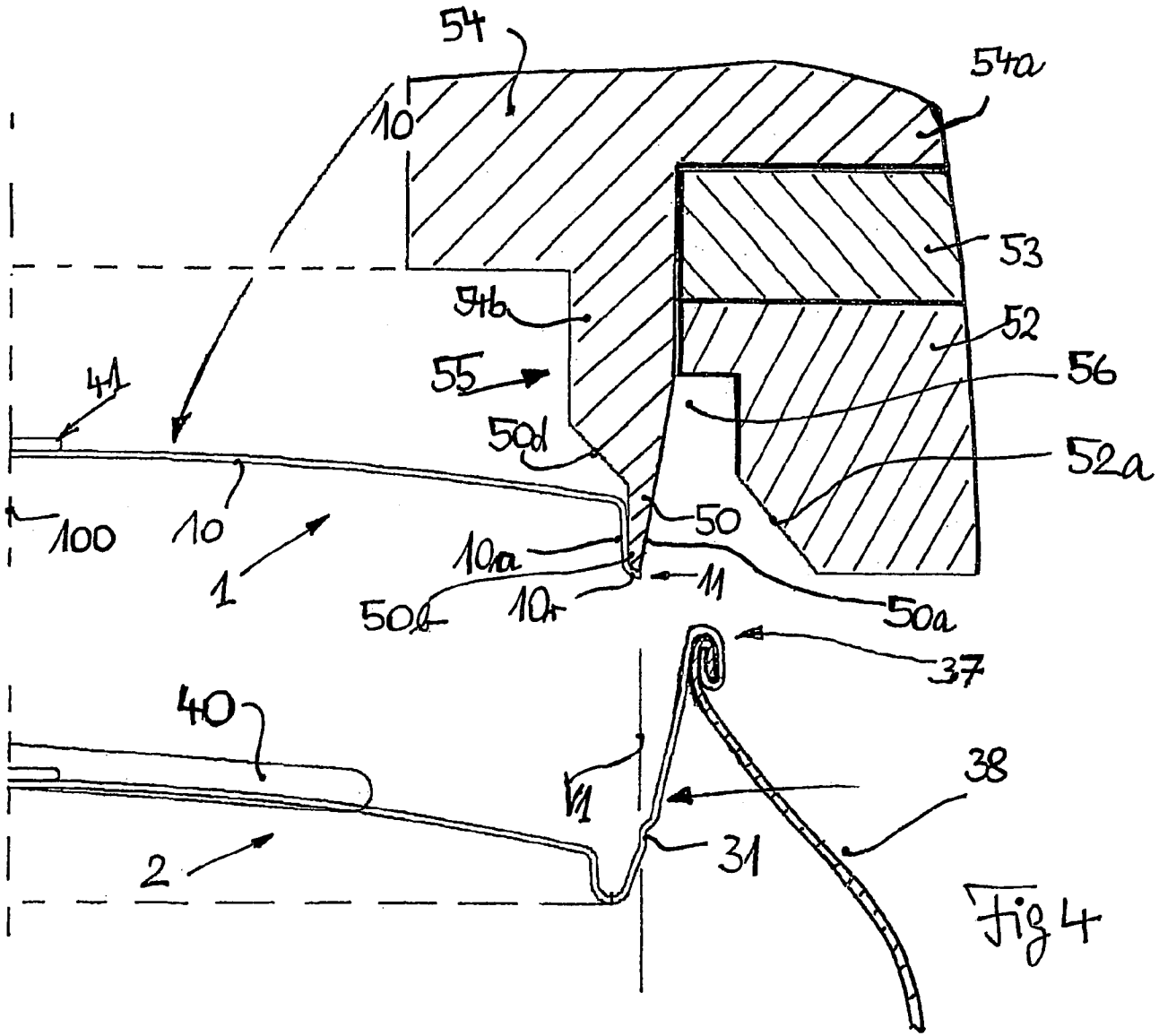
FIG. 4 shows an enlarged representation of the engagement tool in the upper portion of FIG. 3, wherein this figure elucidates the insertion of the outer cover panel 10 with the apron 10*a*, 10*b*, 10*r* by means of the joining rib 50.

When the cover is pressed in by means of an upper tool part that is illustrated in FIG. 3 and FIG. 4, the free edge 11 is displaced by at least the differential dimension dr, wherein a radial force $f_r$ is exerted and springably acts upon the apron wall 10*a* and, if applicable, slightly deforms the radial apron section 10*r* axially downward and/or causes a slight upward curvature of the cover panel 10 such that an elastically acting force is generated. This stress upon the apron wall results in a predominantly elastic deformation and only a slight plastic deformation, wherein the elastic deformation ensures that the edge 11 along the annular surface V1 is moved past the curved step 31*c* and placed on the strip 31. When the tool part with the joining rib 50 according to FIG. 4 is axially extended, the elastic force $f_{11}$ according to FIG. 1 remains effective and the apron wall 10*a* with the radial sections 10*b*, 10*r* and its free edge 11 is clamped on the strip 31. This results in the formation of a second groove 1*a* that lies radially outward and axially above the first groove 2*a*. The second groove also extends peripherally and is visible from the outside while the first groove remains concealed due to the insertion of the second cover panel 10 with its apron. The thusly formed interior space 20 consequently is also concealed, but accessible by means of the opening strap 41—as described below.

Figure 2A:
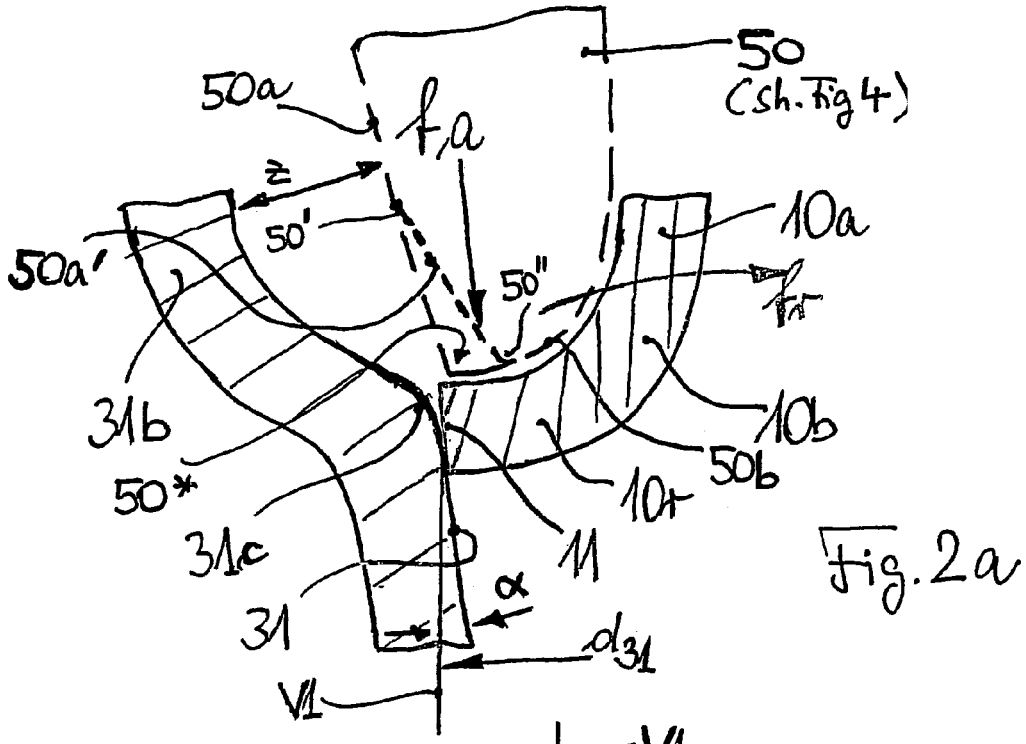
FIG. 2*a* shows an enlarged representation of the press fit 31 when pressing in an edge 11 of a lower section 10*r* of an apron section 10*a* on the edge of the outer cover panel 10 by means of a joining rib 50.

The forces exerted by the free edge 11 during the formation of the clamping point on the seat 31 are illustrated in the form of an enlarged detail in FIG. 2*a*. The first curvature 31*b* has a larger curvature radius that the second curvature 31*c*. The narrow peripheral strip 31 begins at this second curvature, wherein this strip serves as a support point or seat for absorbing a clamping force $f_{11}$ that is transmitted by the edge 11, but generated due to the largely elastic yielding of the apron wall 10*a*, 10*r*, a slight plastic deformation and a slight upward curvature of the cover panel 10. The forces $f_a$ and $f_r$ acting during the insertion of the second cover panel 10 are illustrated in FIG. 2*a*. An inward yielding of the apron wall caused by the force $f_r$ and an inward pressure that is exerted by means of the tool 50 illustrated with broken lines in FIG. 4 and caused by the axial force $f_a$ result in the free edge 11 being pressed past the curvature 31*c* such that it reaches the seat 31. When the tool 50 is retracted, the force component $f_{11}$ remains effective and ensures a reliable seat due to the press fit in the form of a frictional connection.

Figure 2:
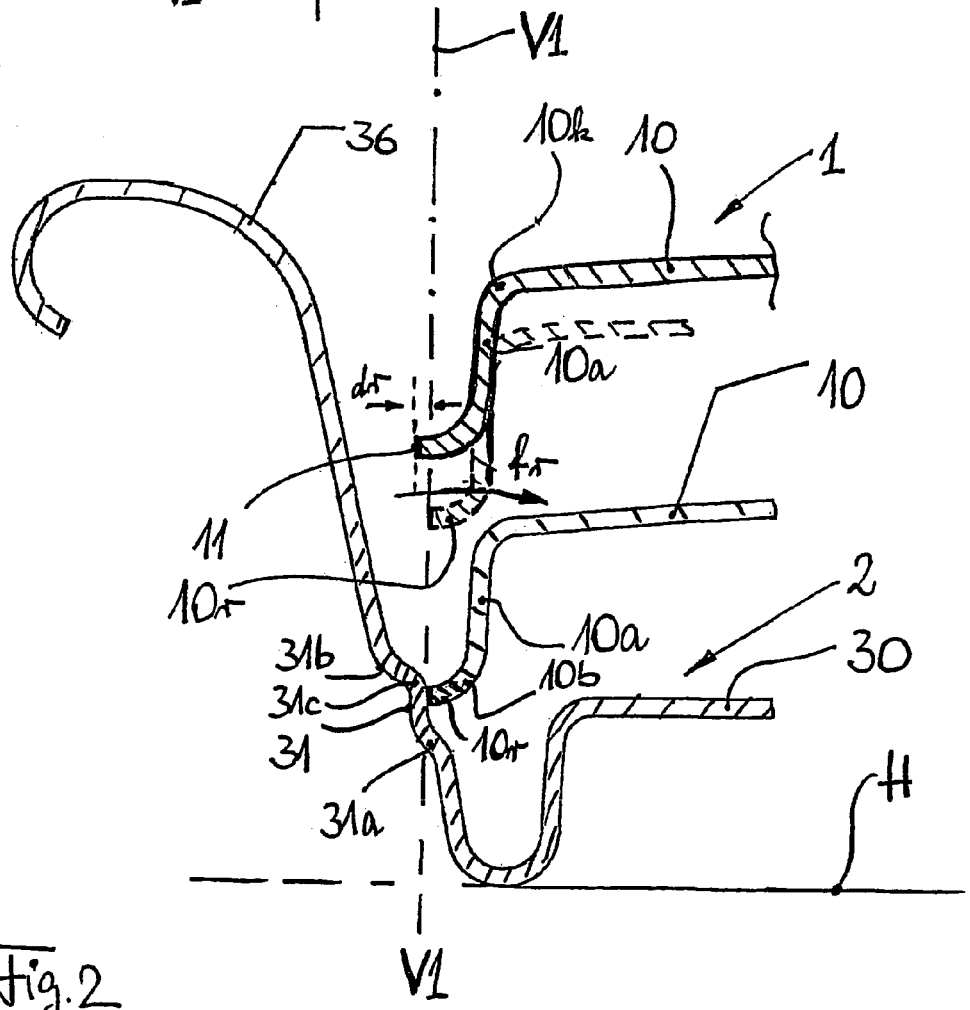
FIG. 2 shows two stages of the incorporation of the outer cover panel into the press fit radially outside the lower cover panel.

This placement or insertion which may also be referred to as the formation of the press fit in the form of a frictional connection is discussed in greater detail below with reference to FIG. 2. The reference symbols used are identical to those in FIG. 1. In this respect, one may also consult FIGS. 4 and 4*a* which show how the upper tool attaches the upper cover panel 10 that, in connection with its apron wall 10*a*, 10*r*, may also be referred to as a cover section 1 to the lower or inner (functional) cover 2. For this purpose, a joining rib 50 that is realized in the form of a peripheral, axially extending extension of the upper tool head 54 engages on the apron 10*a*, 10*b*, 10*r* with a radial, peripheral support 54*a* and an axial extension 54*b* such that a tight contact is produced at least with the groove bottom 10*r* of the apron. The joining rib 50 that serves as the engagement part of the tool head 55 has an inwardly directed surface 50*b* that essentially extends axially and is realized in an arc-shaped fashion in accordance with the curvature 10*b*, 10*r* in its lower region. The joining rib abruptly ends essentially at the same radial dimension, at which the free edge 11 ends on the curved section 10*r* of the apron wall, and then extends upward with an obliquely inclined annular surface 50*a*. The dimension and orientation of the annular surface 50*a* are chosen such that it does not adjoin the outer wall 35, but rather remains spaced apart therefrom by a distance z when the upper tool part 55 is lowered and moved past the press fit 31, i.e., the peripheral strip-shaped wall section 31, with its transition region at the bend 50* between the two surfaces 50*b* and 50*a*. This movement past the press fit is illustrated in FIG. 2.

In this case, the joining rib 50 is not shown, but only the axial and radial movement of the apron 10*a*, 10*r*. An elastic deformation for reducing the differential dimension dr to zero and preferably slight negative values referred to the annular surface V1 is achieved with the axial pressure of the joining rib 50, namely when the free edge 11 is pressed radially inward by the shoulder 31*c* while the axial force $f_a$ of the rib 50 acts upon the radial section 10*r* of the apron. This is illustrated in the form of the resulting force $f_r$, wherein the upper cover section 1 was already lowered in the axial direction by a short distance as illustrated with broken lines. This represents the inserted state.

In the inserted state, the force $f_{11}$ is exerted upon the seat 31 by the free edge 11. The state of the cover which is illustrated with broken lines consequently corresponds to the mounted or inserted state, in which the free edge 11 is pressed radially inward past the shoulder 31*c*. In this case, the generated force is defined by the excess radial dimension dr. If this dimension is excessively large, problems may arise during the mounting and the separation forces to be exerted become very high. If the differential dimension (excess dimension) dr is not sufficiently large, the forces acting in the press fit are not sufficiently high and the second cover panel cannot be reliably mounted.

A slight geometric incline a of the seat 31 in the form of a conical design with an angle >0° up to approximately 6° simplifies the placement of the free edge 11 on the seat 31. This means that a radially increasing force is generated as the seat is axially lowered or that a catch point 31*c* needs to be overcome at negative angles.

The reference surface V1 is aligned with the shoulder 31*c* and extends parallel to the axis 100. This reference surface has a diameter $d_{31}$ that is illustrated in FIG. 2*a*. The indicated differential dimension dr which becomes negative after passing over the step 31*c* and was previously positive is based on this diameter.

The axial height of the press fit 31, 11 essentially lies at the height $h_{30}$ referred to a horizontal plane H that is defined by the groove bottom 30*r* of the inner peripheral groove 2*a* in this case.

The height $h_{31}$ of the annular strip 31 in the linear region needs to at least correspond to the sheet thickness of the free edge 11. However, the height of the narrow strip preferably amounts to two-times or three-times the sheet thickness at the clamping point. The axial height of the clamping point approximately corresponds to the height $h_{30}$, wherein this height is, however, dependent on the desired volume or the height $h_{20}$ of the chamber 20 at the location of the handle straps 40, 41. Measured in the axial direction, the axial heights of the inner wall sections 30*a*, 10*a* are essentially identical in order to provide the grooves 2*a*, 1*a* with the most similar appearance possible. However, a slight deviation from the curvature 31*c* with the smaller curvature radius cannot always be prevented at the transition to the clamping point. This slight deviation is barely visible from the outside when the first cover section 1 is in the clamped position.

The appearance of the cover in the assembled (mounted) state corresponds to that of a conventional cover with the geometry that is very similar to that formed by the wall section 35, the continuation in the form of the apron 10*r*, 10*a* and the outer cover panel 10. This means that the inner cover panel 30 is lowered in comparison with a conventional beverage can. This is achieved by extending the wall 35 because it is initially followed by the outer groove wall 30*b* and the strip 31 lying in between. However, the curvature region 31*b* still acts as a section of a groove bottom that corresponds to that of the groove bottom 30*r* of the inner groove 2*a*. The continuation of this groove bottom is, however, not continuous, but realized with the seat of the edge 11 on the strip 31. This is achieved with the curved section 10*r* and the inner wall 10*a* of the apron on the upper cover panel 10. This section 10*r*, 10*a* of the apron corresponds to the section 30*r*, 30*a* of the inner cover that is not referred to as an apron, but rather an inner groove wall and a groove bottom.

The curvature 31*b* has a larger curvature radius than of the curvatures 31*c* and 31*a*. These two steps define the transition into the strip region 31 and out of this strip region 31, wherein the strip 31 is essentially aligned axially, however, in a slightly inclined fashion. The clamping edge 11 is able to reach its seat much easier if the strip region 31 has a slight outwardly directed incline.

A separation of the press fit can be achieved by overcoming the radial force $f_{11}$. This radial force is overcome with an axial tensile force that originates from the cover panel 10 and is caused by the handle strap 41. When the handle strap is actuated, a tensile force is generated which separates the edge 11 from the strip 31 and causes the outer cover panel 10 to pop out when the radial tensile force $f_{11}$ is released. This causes the upper cover panel 10 to be removed from the inner cover panel 30 such that the chamber 20 becomes accessible in order to remove the object 44 or 45 stored therein. During the opening movement, the upper break-open part in the cover panel 10 may also open at least superficially such that a support effect is produced on the object 45 and the axial tensile force can be exerted in a superior fashion. If a disk 44 is inserted which is partially placed around the handle part 40, the tensile force can also be exerted without the support effect. In this case, the disk improves the occurring pop-out effect such that the separation of the upper cover takes place surprisingly, but definitively.

It would also be conceivable to realize other geometries than that shown in FIG. 2, wherein the apron wall 10*a* has, for example, a radially inward directed curvature region in order to engage on the inner groove wall 30*a* of the groove 2*a*. In this case, the force is directed radially inward. Based on the previous description, a person skilled in the art would be able to conceive other possibilities for generating the clamping force $f_{11}$.

FIG. 4 is described in greater detail below with respect to its upper tool part. This specifically pertains to the tool surfaces 50*b* and 50*a* of the joining rib 50 which are illustrated in an enlarged fashion in FIG. 2*a*. The peripheral surface 50*a* that is realized in the form of an oblique conical surface ends in an upper receptacle chamber 56 that is open toward the bottom. This receptacle chamber has such dimensions that it is able to overlap a folded seam 37 as shown in the left half of FIG. 3. An outer tool part 52 and an intermediate part 53*a* ensure a rigid seat of the tool part 54*b* that carries the joining rib 50 above the body section 54 on a support section of the tool head which is illustrated in greater detail in FIG. 3. This tool head can be moved in the axial direction by means of a not-shown device in order to reach the engagement position illustrated in the left half of FIG. 3 and the starting position illustrated in the right half of FIG. 3. In the starting position that is also illustrated in the upper portion of FIG. 4, a cover section 1 with its apron wall 10*a*, 10*r* is placed against the joining rib 50 and held thereon by means of a vacuum such that the free edge 11 is able to slide past the seat 31 when the tool is lowered. When the free edge slides past the seat, the downwardly open space 56 accommodates the finished folded seam 37 that is situated on the upper edge of the beverage can 3 and realized by producing a folded seam connection between the cover edge 36 and a not-shown can body flange. The oblique surface 52*a* on the tool part 52 ensures that the tool head does not collide with a reduced section 38 of the beverage can body 3 and is adapted to the reduced upper body section of the beverage can.

The surfaces 50*a*, 52*a* as well as the downwardly open receptacle chamber 56 form a peripheral receptacle ring on the upper tool part which accommodates the folded seam region 37, wherein the cover section 1 is placed on the press fit 31 on the radially inner side and the can is otherwise not contacted or damaged.

The inner surface 50*a* is spaced apart from the wall 35 by a distance z that is clearly illustrated in FIG. 4 and FIG. 2, but may also have another shape as long as it is realized such that it moves past the press fit of the strip 31 at least in the lower section in the region of the free edge 11.

The surface 50*b* that this curved in the shape of an arc results in a contact surface that is relatively broad in comparison with the radial dimension of the lower arc section 10*a*, 10*r* of the apron, wherein this broad contact surface serves for exerting the insertion force $f_a$ according to FIG. 2*a* when the upper tool part 55 is lowered as shown in FIG. 3. For example, an additional bevel 50*a*' is provided in the lower end region of the surface 50*a* or a curvature on the surface bends 50' and 50" or 50* is realized with a (not-shown) smaller curvature radius as illustrated on the lower end of the joining rib 50 in FIG. 2*a*.

Figure 4A:
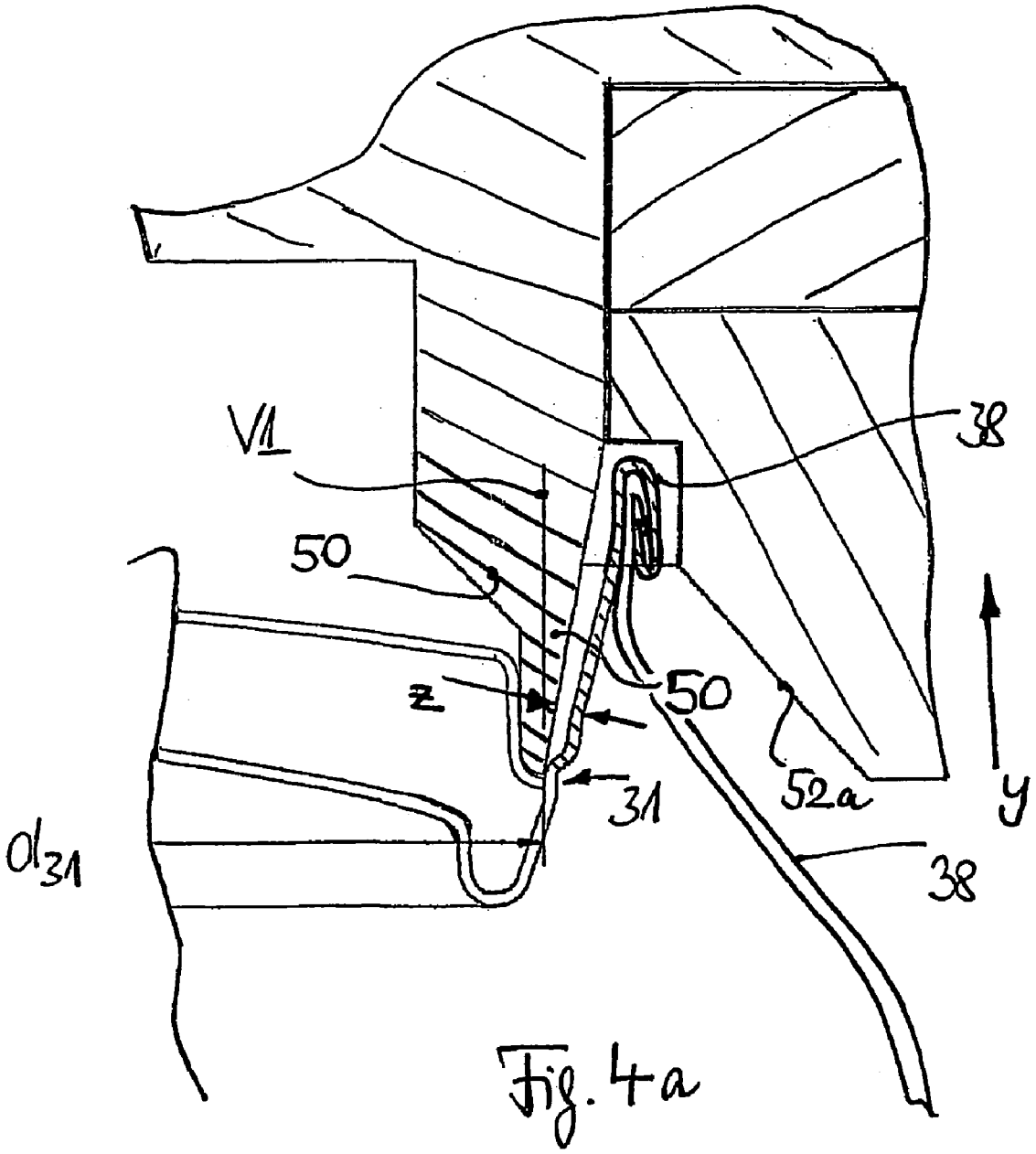
FIG. 4*a* shows the tool according to FIG. 4 in the lowered state, wherein the joining rib 50 is illustrated at the beginning of its upward stroke y.

The state shown in the left half of FIG. 3 is illustrated in an enlarged fashion in FIG. 4*a*, wherein the mounting tool with its rib 50 currently carries out the upward stroke y. This figure shows the reference dimensions, in particular, of the strip region 31, its diameter $d_{31}$, as well as the distance z and the annular surface V1 that lies on the step 31*c*. The edge 11 is placed underneath the dimension $d_{31}$, and the outer surface 50*a* of the rib 50 contacts or is spaced apart from the strip 31 by a very slight distance. When the tool is raised, the distance is additionally increased, and the differential dimension dr becomes smaller than zero in the mounted state. The mounted state is the reference point for the maximum radial dimension of the front geometry 50*a* up to the bend 50*. If the state shown in FIG. 2 in the upper position of the outer cover panel 10 would hypothetically be illustrated, the bend would lie within the line V1, i.e., the radial dimension dr would protrude over the bend 50*. Accordingly, the end of the inwardly directed surface 50*b* and the beginning of the upwardly directed surface 50*a* need to lie slightly farther radially inward on the cover seat or at least its upper step 31*c* if the strip 31 is conically inclined. This defines the critical dimensions of the rib geometry, wherein the clamping force is defined by the differential dimension dr in the non-clamped state.

The value of the differential dimension "dr" in FIG. 2 is adapted such that a radially exerted force $f_{11}$ is not excessively high and the cover section 1 can be removed from the press fit by actuating the opening system 41. Values between 1/10 and 2/10 mm proved to be reliable dr dimensions. The inner cover diameter $d_{31}$ at the lower end of the step 31*c* and the beginning of the annular region 31 amounts to 48.59 mm in this embodiment. The thusly generated force lies below 30N to 35N in order to allow a practical opening of the can. However, this force cannot be precisely predicted and is subject to an adjusting process that is based on an iterative method and described below.

The mounting tool for inserting the upper cover panel 10 of the outer cover section 1 with its apron wall consisting of an axial section 10*a* and a radially aligned bottom or arc section 10*b*, 10*r* was already mentioned above. The joining rib 50 that engages on the radially outer side of the apron wall has a longer axial length than that of the apron with its axial section 10*a* and comprises an inwardly directed upper surface 50*d* with a steeper incline than a surface 50*a* that is slightly inclined outward and oriented at an angle >0° but <30°, preferably between 10° and 15°. The outwardly directed surface ends on the bend 50* near the free edge 11 on the lower end of the joining rib 50, wherein the bend transforms into an arc segment 50*b* that defines the inwardly directed second surface of the joining rib 50. It is adapted to at least the radial arc segment 10*a*, 10*r* and largely in contact with these segments at the beginning of the insertion process, in particular with the arc segment 10*r*.

When the cover segment 1 is lowered while it adjoins the joining rib and is held thereon by a vacuum as illustrated in the upper half of FIG. 4, the bend of the tool passes the radially inward directed annular strip 31 between the surfaces 50*b*, 50*a* along the vertically oriented annular surface V1 and places the free edge against this annular strip. Subsequently, the tool part 54 with the joining rib 50 is moved upward again. The generated elastic force is stored when the excess dimension dr overcomes the step 31*c* and part of the apron wall 10*a* is elastically deformed. This results in a frictional connection on the seat 31.

The receptacle chamber 56 has such dimensions that it is able to accommodate the folded seam 37 according to FIG. 3 as illustrated in the left half of FIG. 3.

The axially upper position of the tool 55 is shown in the right half of FIG. 4 and FIG. 3. The retracted, axially lowered position is illustrated in the left half of FIG. 3. This elucidates the function and the operation as well as the geometric structure of the upper tool that serves as the mounting tool for the cover, in particular the upper section 1 of a complete cover.

The outer surface of the joining rib 50 which is illustrated in the form of a plane surface 50*a* may also have a different shape. It is merely important that it is incorporated into the press fit. A distance z of this outer surface 50*a* from the cover wall 35 causes the mounting tool to safely move past and prevent any mechanical deformation of the remaining cover, namely because the cover segment 10 only needs to be placed in position and the cover geometry should not be changed by the mounting tool. The distance z is illustrated in FIG. 4*a*, wherein an essentially constant strip spacing is formed between the outer is surface 50*a* and the obliquely extending cover wall 35 up to the beginning of the mounting edge 36 of the cover.

The elements 52, 53 of the mounting tool which lie farther radially outward are fixed on the head part 54*a* of the upper section 54 of the tool with a screw as shown in FIG. 3 in order to make it possible to exchange the joining rib 50 with the support sections 54, 54*a* arranged thereon.

Figure 5:
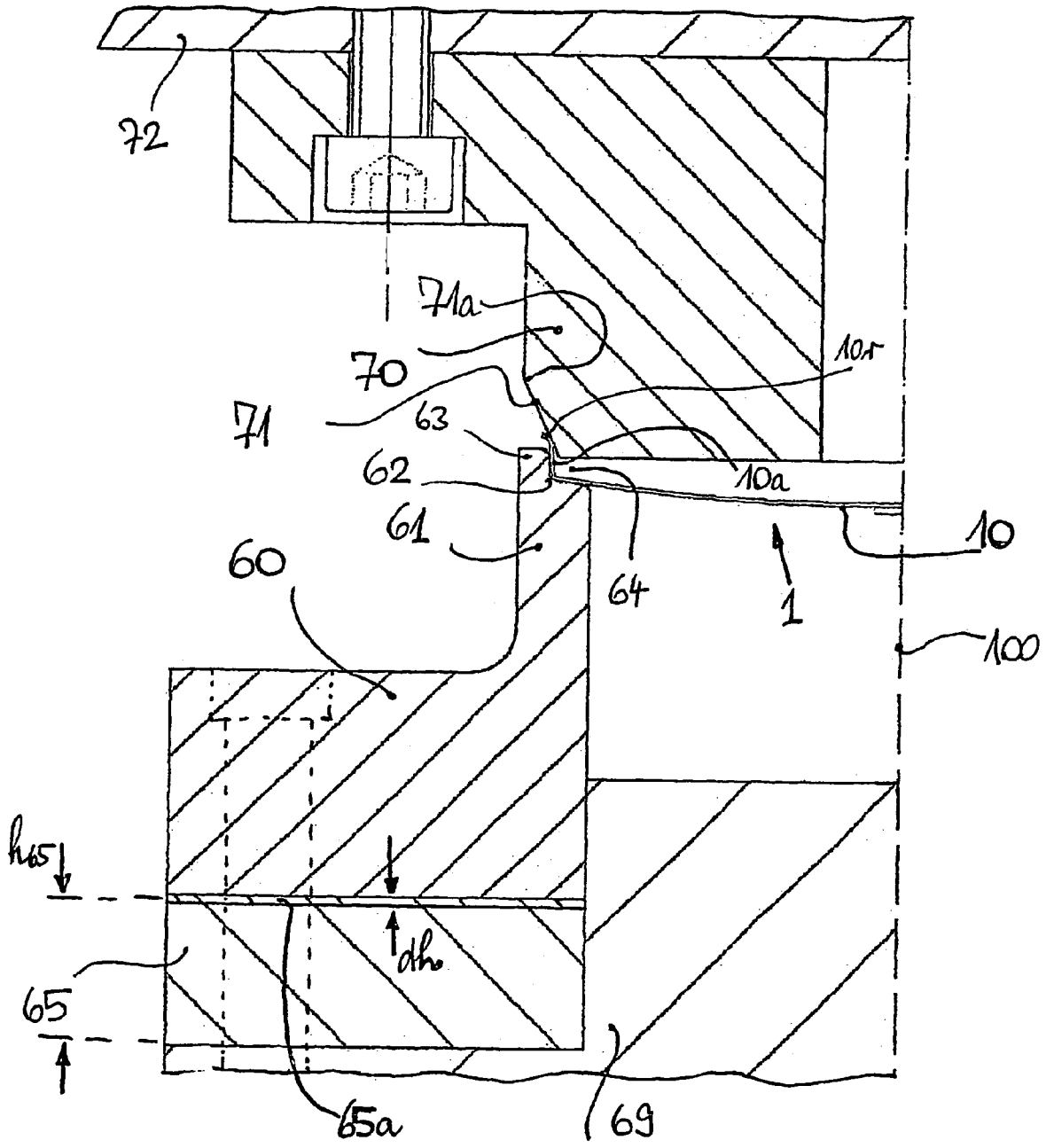
FIG. 5 shows a calibrating tool for calibrating the apron 10*a*, 10*b*, 10*r* on the outer cover panel 10 or cover section 1 in such a way that it generates the desired clamping force in the above-described press fit.

The attachment of the clamping edge 11 to the seat 31 depends on the elastic force $f_{11}$ required for achieving a reliable press fit and a separation of this press fit when the opening lever is actuated. In this respect, the excess dimension dr or differential dimension according to FIG. 2 is very important. This dimension is defined by the geometry and the dimensions of the upper cover section 1 after the punching process, as well as a first plastic deformation of the apron wall 10*a* in its idle position. This plastic deformation (for example by means of deep-drawing) can be changed with another tool that is shown in FIG. 5. This means that the radial dimension dr can be precisely adjusted in addition to or independently of the geometric dimensions after the punching process and a deformation of this upper cover segment 1. During these processes, deviations may occur which can be influenced, compensated and defined anew with the calibrating tool according to FIG. 5 by means of a subsequent deformation.

An upper tool part 70 and a lower tool part 60 can be moved relative to one another in the direction of the axis 100. The upper tool part 70 preferably can be adjusted in the axial direction while the lower tool part 60 that serves as a support part remains stationary. It contains a body 69 in the form of a lower support part and a spacer 65 that defines the axial dimension $h_{65}$ of the support part 60. The support part 60 comprises a collar 61 that points upward and is provided with an annularly extending recess 64 comprising an inner edge 62 and an outer annular web 63. As described above, the annular web 63 is shorter than the apron wall 10*a*.

A cover segment 1 according to FIG. 2 is inserted into the annular recess 64 in a reversed fashion (cover panel downward) such that the curvature 10*k* of the cover panel lies near the inner edge 62 of the recess 64. This figure also shows the axis 100, wherein the tool is realized symmetrically referred to this axis and only the left half is illustrated and described.

The upper tool part 70 has a calibrating head with an inclined outer surface 71 that is adapted to the radial dimension of the recess 64 in such a way that the inner end lies within the recess and the outer end 71*a* of the inclined surface 71 lies outside said recess. This provides an adjusting range that is not dependent on the penetration depth of the upper calibrating head 70 arranged on a support element 72.

When the edge region of the cover panel 10 is attached, an upper apron section with its outwardly directed curvature 10*r* is open toward the top and able to engage with the inclined surface 71, wherein the lower end of the inclined surface passes the curvature 10*r*, but contacts the inner surface of the curved section 10*r* at a certain axial position during the course of the adjusting movement. Once this contact takes place, the apron wall 10*a* is deformed in a plastic fashion in order to bend the arc segment 10*r* farther outward and to thusly obtain a different differential dimension dr.

A very precise adjustment of the plastic deformation for a preset axial penetration depth can be achieved by varying the height $h_{65}$ of the spacer 65 in small increments dn, for example in increments of 0.05 mm with the aid of spacers 65*a*. Analogous to the lower tool part 60, the penetration depth can also be adjusted on the upper tool head 70 by varying the height of the spacer 65. The relative displacement may also be realized in the form of a movement of the receptacle part 60 relative to the stationary calibrating head 70.

The precise adjustment of dr is realized by adjusting the height $h_{65}$ of the spacer 65. Practical results were achieved with an adjustment in increments dh between 0.02 mm and 0.2 mm.

Subsequently, a test step is carried out, in which a frictional connection is produced between the apron edge 10*a* on the cover panel 10 which was deformed in a plastic fashion with a predetermined height $h_{65}$ and the second cover section 2 with the lower cover panel 30 by means of the mounting tool according to FIG. 3. An opening test with the handle lever indicates a measurable force that is reached while the spacer 65 is adjusted during the course of the subsequent opening process. If this force is excessively high, the spacer 65 can be varied in the above-described small increments dh, i.e., reduced in this case. If the required force is excessively low, the plastic deformation needs to be increased. This is achieved by increasing the height $h_{65}$. This means that the inclined surface 71 of the calibrating tool 70 that remains adjusted to the same penetration depth is additionally lowered and subjects the arc section 10*r* and part of the axial apron section 10*a* thereof or a newly inserted cover section 1 to a slightly higher degree of plastic deformation such that a higher value of dr is obtained.

This is followed by another test, in which a frictional connection is produced between the upper cover section 1 that was deformed with a higher degree of plastic deformation and an increased dr value and the lower cover 2 with the cover panel 10 by means of the tool according to FIG. 3. The forced exerted during the opening process is again measured on the opening system 41 with a tensiometer, and the opening force can be accordingly determined, measured and adjusted by incrementally varying the height $h_{65}$.

Once the tool is adjusted in this fashion, additional cover segments 1 are manufactured in large quantities in order to produce the press fits 31, 11 in equally large quantities by means of the mounting tool according to FIG. 3.

We claim:

1. A cover for a beverage can body, wherein said cover comprises an inner and an outer cover panel that are spaced apart from one another in an axial direction to form an intermediate space adapted to accommodate a physical object that is invisible from the outside from a viewing direction toward the outer cover panel; wherein (a) the inner cover panel is connected to a mounting edge via a curved section that forms a peripheral groove around the cover panel, the edge adapted for an attachment to the beverage can body;

(b) the outer cover panel is clamped relative to the inner cover panel with an essentially radial force component forming a clamping point on a narrow peripheral strip between the mounting edge and the curved section to fix an axial distance of the outer cover panel relative to the inner cover panel; and (c) wherein the wall section forms part of a cover wall that extends at an incline relative to the axial direction, and wherein the wall section comprises the narrow peripheral strip that is oriented essentially parallel to the axial direction and has an upper and a lower shoulder, the upper shoulder merging into the inclined cover wall and the lower shoulder merging into an outer wall section of the peripheral groove.

2. The cover according to claim 1, wherein the clamping point is radially outside the inner cover panel.

3. The cover according to claim 1, wherein the radial force component is an elastic force that acts radially outward.

4. The cover according to claim 1, wherein the outer cover panel comprises a radially and axially extending edge section and the force is transmitted and at least partially generated by the edge section.

5. The cover according to claim 1, wherein the outer cover panel contains an edge section with a certain sheet thickness, and wherein the narrow peripheral strip has an axial height that amounts to a multiple of this sheet thickness.

6. The cover according to claim 1, wherein the peripheral strip extends essentially parallel to the axial direction in a slight incline that is smaller than a more significant incline of at least one higher section of the cover wall.

7. The cover according to claim 1, wherein an elastic force component that acts as a clamping force produces a press fit that can be separated by exerting an at least axially directed tensile force component in order to remove the outer cover panel from the inner cover panel and to expose the intermediate space.

8. The cover according to claim 1, wherein the mounting edge is designed for producing a folded seam connection with an adapted flange on the can body.

9. The cover according to claim 1, wherein the cover consists essentially of sheet metal.

10. The cover according to claim 1, wherein the distance between the cover panels is chosen such that the physical object fulfills a support function during the opening of the outer cover panel in order to separate the clamping point.

11. The cover according to claim 1, wherein the peripheral strip, extends inclined such that it widens upward by an angle between 0° and 6° relative to the axial direction or an annular surface that extends through the clamping point.

12. The cover according to claim 1, wherein the clamping point lies at an axial height that essentially corresponds to the axial height of the inner cover panel relative to the lowest point of the peripheral groove of a cover or relative to a ground contact surface of a closed beverage can as the lowest point.

13. The cover according to claim 1, wherein the peripheral strip comprises an upper and a lower edge region that merge into wall sections of the cover wall in the form of steps.

14. The cover according to claim 1, wherein (aa) an edge section of the outer cover panel contains a partially U-shaped apron section, essentially half of another groove, as well as a radially oriented outer edge on the end of the apron section;

(bb) a partially U-shaped curvature section, essentially the other half of the other groove, is provided in the cover wall between the curved section of the inner cover panel which forms a first groove bottom--and the mounting edge;

wherein the outer edge exerts a radially outward directed force underneath the partially U-shaped curvature section in order to form a second groove bottom of a second peripheral groove that, when observed from the outside, essentially appears optically identical to the first groove bottom or like a groove bottom of a cover that is only provided with one peripheral groove.

15. The cover according to claim 1, wherein the outer cover panel contains an outer handle part for actuating an outer opening region in the cover panel.

16. The cover according to claim 15, wherein the inner cover panel contains an inner handle part that lies axially underneath the outer handle part and serves for exposing an opening region in the inner cover panel.

17. The cover according to claim 14, wherein two peripheral grooves are axially and radially offset relative to one another.

18. The cover according to claim 17, wherein both grooves are oriented in the same direction.

* * * * *